US008199181B2

(12) United States Patent
Zaima et al.

(10) Patent No.: US 8,199,181 B2
(45) Date of Patent: Jun. 12, 2012

(54) IMAGE FORMING APPARATUS

(75) Inventors: Nobuhiko Zaima, Abiko (JP); Tomohisa Itagaki, Abiko (JP); Yasuhito Shirafuji, Kashiwa (JP); Takahiro Ishihara, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/021,563

(22) Filed: Feb. 4, 2011

(65) Prior Publication Data

US 2011/0193923 A1 Aug. 11, 2011

(30) Foreign Application Priority Data

Feb. 8, 2010 (WO) ..... PCT/JP2010/051820

(51) Int. Cl.
*B41J 2/47* (2006.01)
*B41J 27/00* (2006.01)

(52) U.S. Cl. ..... 347/251; 347/253; 347/258

(58) Field of Classification Search ..... 347/251, 347/253, 258

See application file for complete search history.

(56) References Cited

U.S. PATENT DOCUMENTS

| | | | | |
|---|---|---|---|---|
| 5,333,038 | A * | 7/1994 | Mizoguchi et al. | 399/46 |
| 5,381,221 | A | 1/1995 | Mizoguchi | |
| 5,438,437 | A | 8/1995 | Mizoguchi | |
| 6,376,837 | B1 * | 4/2002 | Itabashi et al. | 250/234 |
| 2005/0214004 | A1 | 9/2005 | Toyohara | |
| 2007/0166086 | A1 | 7/2007 | Toyohara | |
| 2008/0174782 | A1 * | 7/2008 | Lin | 356/500 |
| 2009/0086245 | A1 | 4/2009 | Sugiyama | |

FOREIGN PATENT DOCUMENTS

| | | | |
|---|---|---|---|
| JP | 2001-272849 | A | 10/2001 |
| JP | 2004-258397 | A | 9/2004 |
| JP | 2005-316440 | A | 11/2005 |
| JP | 2005-321643 | A | 11/2005 |
| JP | 2009-086334 | A | 4/2009 |

* cited by examiner

*Primary Examiner* — Stephen Meier
*Assistant Examiner* — Sarah Al Hashimi
(74) *Attorney, Agent, or Firm* — Canon USA, Inc., IP Division

(57) ABSTRACT

Restricting a screen line number to prevent degradation in graininess depending on the type of recording paper causes a problem in which the image quality of output matter deteriorates. An image forming apparatus according to the present invention changes an exposure area for one pixel used in image formation in accordance with recording paper in consideration of differences in the influence of the height of toner on graininess depending on recording paper.

5 Claims, 11 Drawing Sheets

FIG. 5A
BEFORE FIXING
FIG. 5B
AFTER FIXING
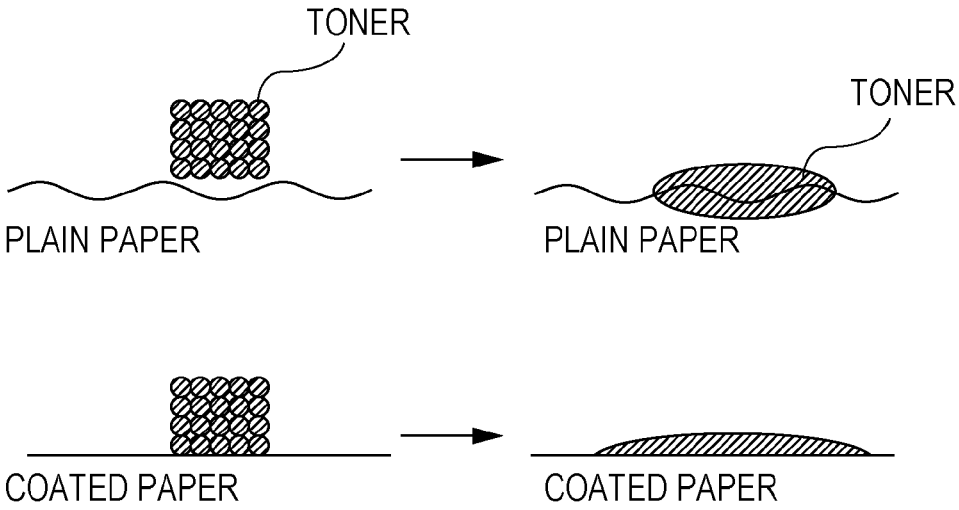
FIG. 6
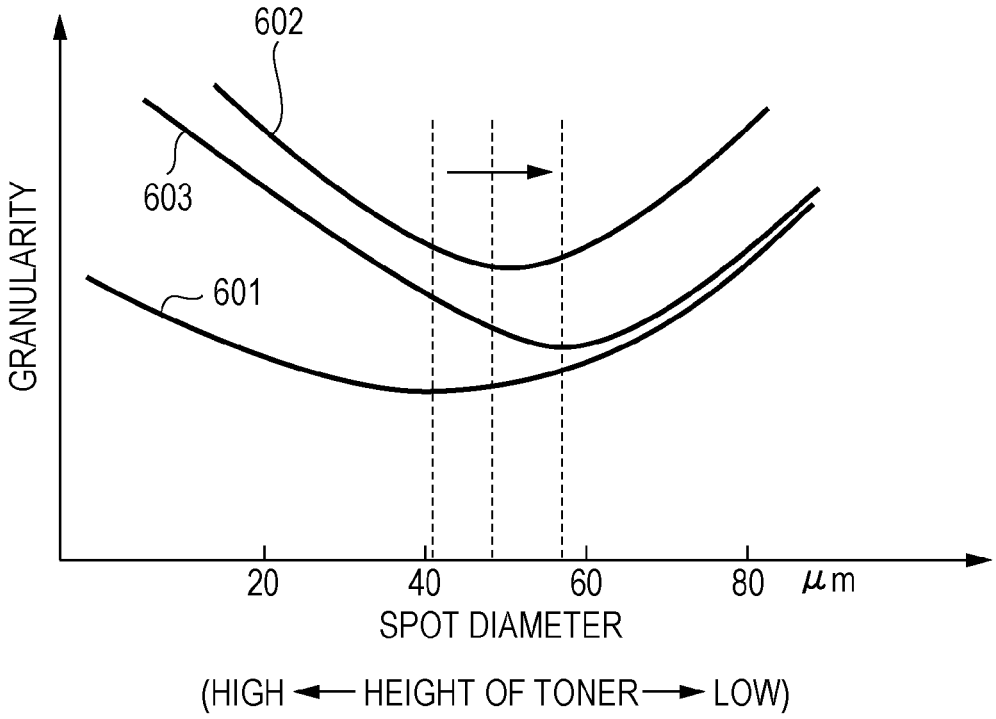

IMAGE FORMING APPARATUS

TECHNICAL FIELD

The present invention relates to an image forming apparatus using electrophotography and, in particular, an image forming apparatus capable of forming an image on a plurality of types of recording paper.

BACKGROUND ART

A recent desired electrophotographic image forming apparatus using toner, such as a printer, copier, and facsimile machine, is the one that can form an image on not only plain paper but also coated paper, which is glossier than plain paper, similarly to the plain paper. Therefore, for current image forming apparatuses, more and more products are becoming able to form an image on coated paper with gloss suited for the coated paper. Generally, fixing toner on coated paper uses a mechanism for obtaining high gloss by flattening a toner layer more reliably to level a toner image on the surface of the coated paper, in comparison with fixing a toner image on plain paper.

There are various types of glossy paper, such as ordinary coated paper and thermoplastic resin coated paper having a toner reception layer to be fused in fixing. For ordinary coated paper, its coating material is not fused at a fixing temperature, and thus toner fused in a fixing process is diffused along the direction of the surface of the coated paper. In contrast, for thermoplastic resin coated paper, its toner reception layer is fused at a fixing temperature, and thus part of the toner fused in a fixing process is fixed so as to be embedded in the toner reception layer. Accordingly, there is a problem in that the density of an image is not uniform because a way of fixing toner is different depending on the type of coated paper. That is, even if toner having the same area and the same amount is placed, an area covered by the toner for ordinary coated paper is larger than that for thermoplastic resin coated paper because of the difference of a fixing process. Therefore, even if an image is formed under the same conditions, the density of the image on ordinary coated paper is higher than that on thermoplastic resin coated paper.

To address this, in the case of image formation on coated paper, a method of setting an image forming condition suited for the type of coated paper with the aim of making the density of the image quality uniform is proposed (see Patent Literature 1). Patent Literature 1 discloses a method of making the screen line number in image formation on ordinary coated paper smaller than that in image formation on thermoplastic resin coated paper.

CITATION LIST

Patent Literature

PTL 1 Japanese Patent Laid-Open No. 2005-316440

However, for the method of Patent Literature 1, the screen line number is restricted, and thus there is a problem in that the image quality of output matter of coated paper is poorer than that of output of plain paper, on which an image can be formed using a freely selectable screen line number. In particular, degradation in the reproducibility caused by the difference in resolution or degradation in image quality caused by visually noticeable screen structure is a problem. Accordingly, depending on the type of recording paper on which an image is to be formed, the problem of deterioration in the reproducibility of an original image arises.

SUMMARY OF INVENTION

The present invention is made in light of the above problems. An image forming apparatus according to the present invention is an image forming apparatus for forming an image on a recording medium. The image forming apparatus includes a photo conductor, a light source configured to emit a light beam for exposing the photo conductor, an optical lens configured to guide the light beam on the photo conductor, the optical lens being disposed between the photo conductor and the light source, a development unit configured to develop an electrostatic latent image using toner, the electrostatic latent image being formed on the photo conductor by exposure with the light beam, a transfer unit configured to transfer a toner image on the photo conductor to the recording medium, a fixing unit configured to fix the toner image transferred to the recording medium by the transfer unit on the recording medium; and a control unit configured to move the optical lens along an optical path of the light beam so as to make a spot area of the light beam on the photo conductor in image formation on a first recording medium larger than the spot area in image formation on a second recording medium, the second recording medium having lower surface smoothness or higher penetration of the toner into the recording medium in a state in which the toner image is fixed by the fixing unit in comparison with that of the first recording medium.

Further features of the present invention will become apparent from the following description of exemplary embodiments with reference to the attached drawings.

BRIEF DESCRIPTION OF DRAWINGS

FIGS. 5A and 5B are diagrams illustrating how a toner image is flattened by fixing when toner having the same height and the same amount is placed on plain paper and coated paper.

FIG. 6 illustrates a relationship between a spot diameter and granularity of an image.

DESCRIPTION OF EMBODIMENTS

First Embodiment

Figure 1:
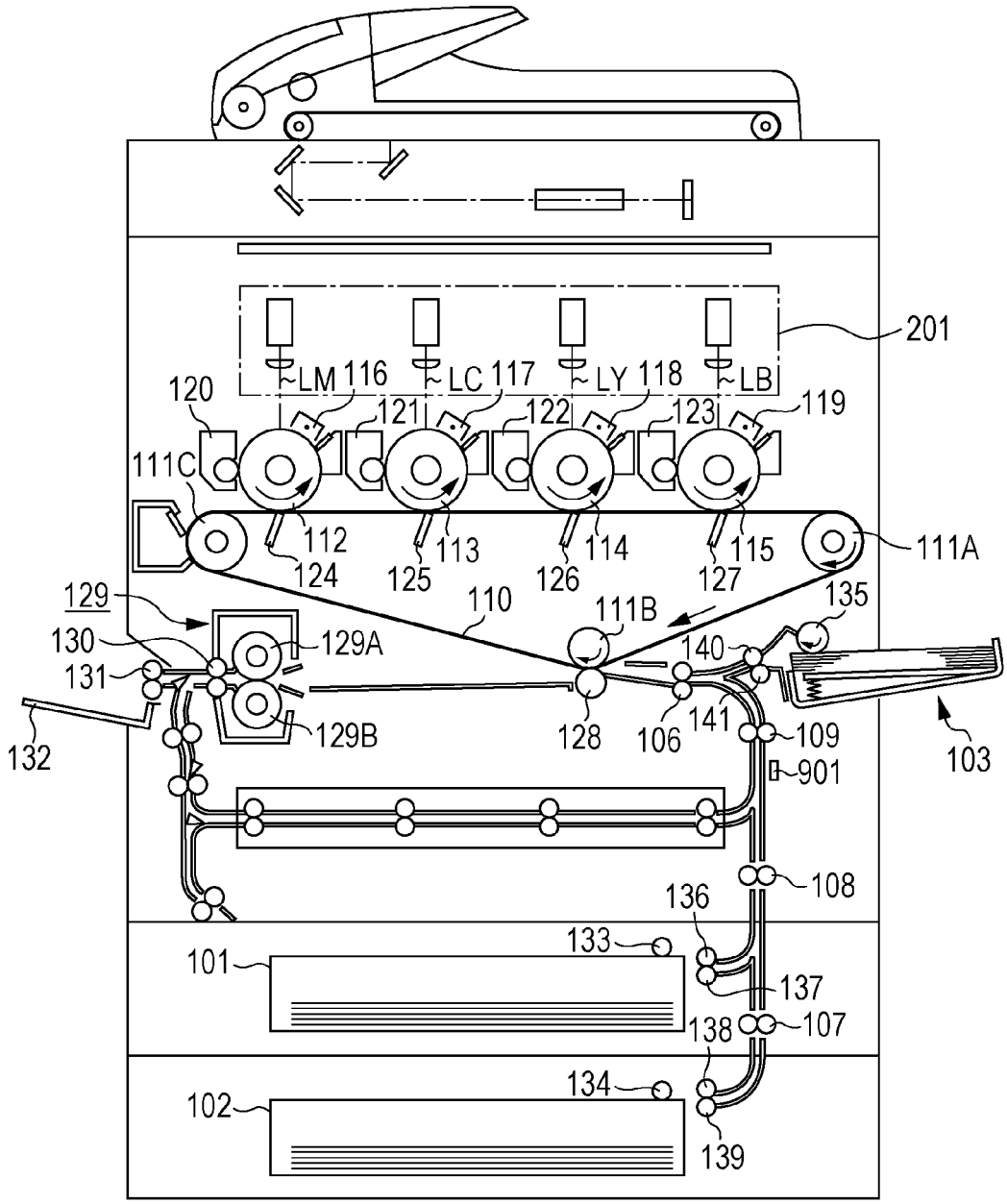
FIG. 1 is a schematic cross-sectional view of an electrophotographic color image forming apparatus.

Embodiments are described in detail below with reference to the drawings. An image forming apparatus according to the present embodiment is described using FIG. 1. FIG. 1 is a schematic cross-sectional view of an electrophotographic color image forming apparatus. For the present embodiment, the color image forming apparatus illustrated in FIG. 1 is used in description, but the embodiments are not limited to the color image forming apparatus, and a monochrome image forming apparatus may also be used.

The color image forming apparatus in FIG. 1 includes two cassette paper feed portions 101 and 102 and a single manual paper feed portion 103. Sheets of recording paper are stacked on the cassette paper feed portions 101 and 102 and the manual paper feed portion 103 for holding recording paper being recording media, and the sheets are pulled out to a conveying path in sequence from the uppermost one of the stack of the sheets by pickup rollers 133, 134, and 135 provided to the respective paper feed portions. Only the uppermost sheet is separated by a pair of separation rollers including a feed roller 136 as conveying unit (conveying means) and a retard roller 137 as separating unit (separating means) from the sheets of recording paper pulled out by the pickup roller 133 from the cassette paper feed portion 101, and the separated sheet is sent to a pair of registration rollers 106 rotating. Only the uppermost sheet is separated by a pair of separation rollers including a feed roller 138 as conveying unit (conveying means) and a retard roller 139 as separating unit (separating means) from the sheets of recording paper pulled out by the pickup roller 134 from the cassette paper feed portion 102, and the separated sheet is sent to the pair of registration rollers 106 rotating. Only the uppermost sheet is separated by a pair of separation rollers including a feed roller 140 as conveying unit (conveying means) and a retard roller 141 as separating unit (separating means) from the sheets of recording paper pulled out by the pickup roller 135 from the manual paper feed portion 103, and the separated sheet is sent to the pair of registration rollers 106 rotating.

In this case, a sheet of recording paper fed from the cassette paper feed portions 101 and 102, which are more remote from the pair of registration rollers 106, is relayed by a plurality of conveying rollers 107, 108, and 109 as conveying unit (conveying means) to the pair of registration rollers 106.

The leading end of a sheet recording paper sent to the pair of registration rollers 106 abuts against the nip of the pair of registration rollers 106. This curves the sheet of recording paper into a loop shape in the conveyance direction, and the movement of recording paper is temporarily stopped. The formation of the loop corrects a skew state of the recording paper.

A long intermediate transfer belt (endless belt) 110 being an intermediate transfer body disposed downstream of the pair of registration rollers 106 extends around a driving roller 111A, a secondary transfer opposite roller 111B, and a tension roller 111C and is set to have an approximately triangular shape in cross-sectional view. The intermediate transfer belt 110 rotates clockwise in the drawing. A plurality of photosensitive drums 112, 113, 114, and 115 for forming and bearing toner images of different colors are arranged in sequence along the direction of rotation of the intermediate transfer belt 110 above the horizontal section of the intermediate transfer belt 110. In the direction of rotation of the intermediate transfer belt 110, the furthest upstream photosensitive drum 112 bears a magenta toner image, the next photosensitive drum 113 bears a cyan toner image, the next photosensitive drum 114 bears a yellow toner image, and the furthest downstream photosensitive drum 115 bears a black toner image.

Next, an image forming process performed by the above image forming apparatus is described. Before being exposed, the photosensitive drums (photo conductor) 112, 113, 114, and 115 are charged by charging devices 116, 117, 118, and 119, respectively. Exposing the furthest upstream photosensitive drum 112 with a laser beam LM based on image data of a magenta component starts, and an electrostatic latent image is formed on the photosensitive drum 112. The laser beam is emitted from a scanner 201 described below. This electrostatic latent image is developed using magenta-color toner supplied from a developing device 120. Subsequently, after the elapse of a specific amount of time from the start of exposing the photosensitive drum 112 with the laser beam LM, exposing the photosensitive drum 113 with a laser beam LC based on image data of a cyan component starts, and an electrostatic latent image is formed on the photosensitive drum 113. This electrostatic latent image is developed using cyan-color toner supplied from a developing device 121. Furthermore, after the elapse of a specific amount of time from the start of exposing the photosensitive drum 113 with the laser beam LC, exposing the photosensitive drum 114 with a laser beam LY based on image data of a yellow component starts, and an electrostatic latent image is formed on the photosensitive drum 114. This electrostatic latent image is developed using yellow-color toner supplied from a developing device 122. After the elapse of a specific amount of time from the start of exposing the photosensitive drum 114 with the laser beam LY, exposing the photosensitive drum 115 with a laser beam LB based on image data of a black component starts, and an electrostatic latent image is formed on the photosensitive drum 115. This electrostatic latent image is developed using black-color toner supplied from a developing device 123. Each of the laser beams LM, LC, LY, and LB is emitted from a scanner described below.

The magenta, cyan, yellow, and black toner images formed on the respective photosensitive drums are transferred on the intermediate transfer belt 110 by sequentially passing through a transfer portion (primary transfer portion) between transfer devices 124, 125, 126, and 127 and the respective photosensitive drums in the course of clockwise rotation of the intermediate transfer belt 110. The toner images transferred on the intermediate transfer belt 110 are transferred to recording paper conveyed by a transfer device 128 at a secondary transfer portion.

The recording paper having passed through the secondary transfer portion is sent to a fixing device 129 being image fixing unit (fixing means) by rotation of the intermediate transfer belt 110. In the course of passage of the recording paper through a nip portion including a fixing roller 129A and a pressure roller 129B in the fixing device 129, heating and pressing the recording paper fixes the transferred toner images on the recording paper. The recording paper that has been subjected to fixing and has passed through the fixing device 129 is sent to a pair of discharge rollers 131 by a pair of conveying rollers 130, and then it is discharged onto a paper output tray 132 outside the apparatus.

Figure 2A:
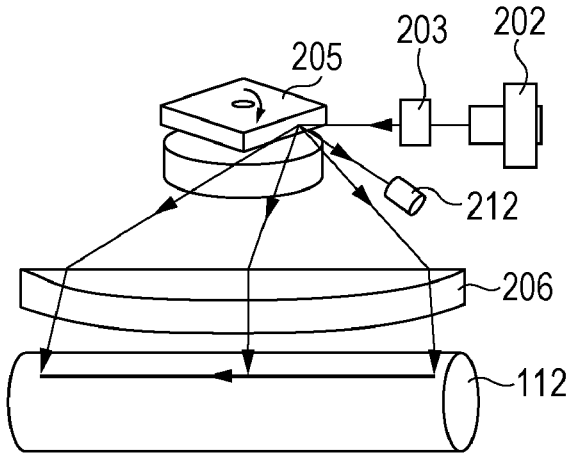
FIGS. 2A and 2B illustrate schematic diagrams of a scanner and a photosensitive drum included in the image forming apparatus illustrated in FIG. 1.

Next, the scanner 201 (optical scanning device) being exposure unit (exposure means) according to the present embodiment and a photosensitive drum exposed with a laser beam (light beam) emitted from the scanner 201 are schematically illustrated in FIG. 2A. The image forming apparatus according to the present embodiment includes a plurality of scanners corresponding to the respective photosensitive drums 112, 113, 114, and 115. The plurality of scanners have the same configuration. Therefore, the scanner 201 for use in exposing the photosensitive drum 112 is described below.

The scanner 201 is provided with a light source 202 for emitting the laser beam LM on the basis of an image signal. The light source 202 includes a semiconductor laser having a central wavelength of 680 nm.

The laser beam LM emitted from the light source 202 is made to be parallel light by passing through a collimating lens 203 (optical lens). The collimating lens 203 is provided with a lens driving portion 304 being focus control unit (control means). After passing through the collimating lens 203, the laser beam LM is deflected and scanned by a rotatable polygonal mirror 205 (polygonal mirror) including six mirrors and being deflection and scanning unit (scanning means) so as to scan on the photosensitive drum. The laser beam LM deflected and scanned by the polygonal mirror 205 passes through an f-θ lens 206 having the function of making the scanning speed of the laser beam LM constant when scanning the photosensitive drum 112 and is guided on the photosensitive drum 112 (on the photo conductor).

A photo diode 212 (beam detector; hereinafter referred to as BD 212) for detecting a laser beam is disposed in a non-image region on a scanning line of the laser beam LM. A synchronization signal (hereinafter referred to as BD signal) is generated by the entry of a laser beam emitted from the light source 202 into the BD 212. After this BD signal is input into a central processing unit (CPU) described below, the CPU outputs an enable signal for permitting emission of a laser beam to a laser driver 303 with a specific timing from the input of the BD signal. This enable signal is transmitted to the laser driver 303 in an image region continuously. When receiving the above enable signal and also receiving input image data, the laser driver 303 causes the light source 202 to emit a laser beam. In this way, the use of a BD signal can match image-writing positions on the photosensitive drum in scans to each other. When the light source 202 is a light source including a plurality of luminous points, a BD signal is generated by the entry of a laser beam emitted from a specific luminous point into the BD. Then, after that BD signal is generated, an enable signal is transmitted to the laser driver 303 with the timing set to each light source.

Here, the image region indicates a scan region that is contained in a region scanned with a laser beam and that is scanned with a laser beam to form an image based on input image data, a toner pattern for use in adjustment of density, and a registration pattern for use in correction of color misregistration. The non-image region indicates a region that is contained in the region scanned with a laser beam and that is other than the above image region.

Figure 2B:
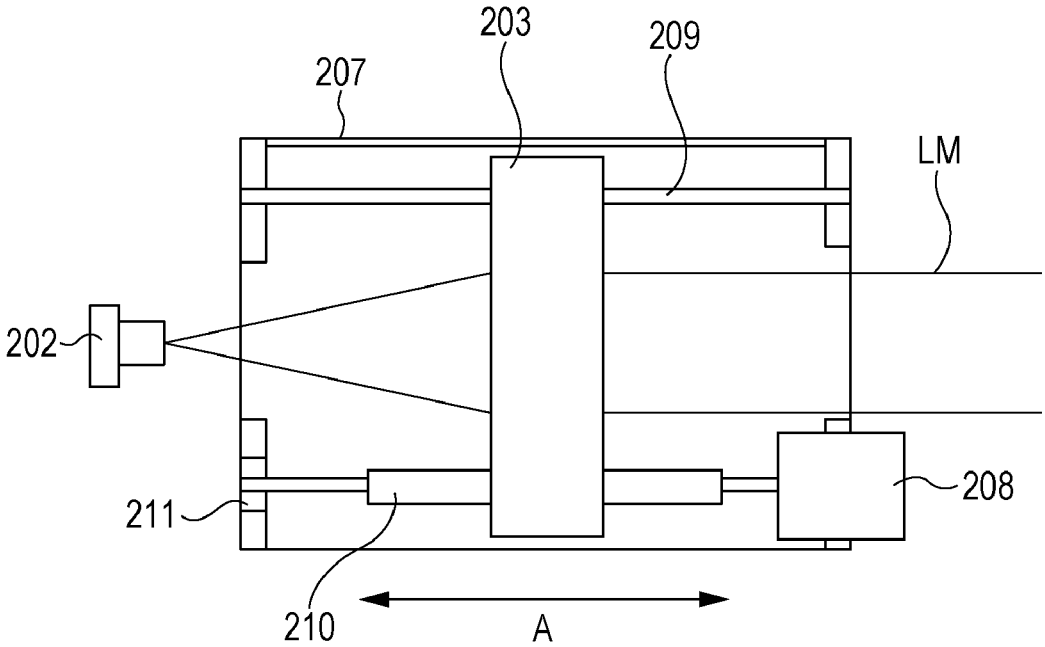

The details of a collimating lens optical system including the lens driving portion 304 and the collimating lens 203 are illustrated in FIG. 2B. In FIG. 2B, the direction of the optical axis of the collimating lens 203 is indicated by the arrows A. As illustrated in FIG. 2B, a frame 207 being hollow in the incoming and outgoing direction of the laser beam LM is provided with a stepping motor 208 being lens driving unit (driving means) and a guide shaft 209. The collimating lens 203 is supported by the guide shaft 209 and a lead screw 210 such that the direction of incidence of light flux of the laser beam LM and the direction of the optical axis of the collimating lens 203 match each other. The collimating lens 203 is provided with a sliding bearing in slidable contact with the guide shaft 209 and an internal screw engaging the lead screw 210. The lead screw 210 is engaged with the stepping motor 208 and is rotated together with the rotation of the stepping motor 208. The frame 207 is provided with a bearing 211 at an end of the lead screw 210 opposite to an end to which the stepping motor 208 is provided. The position of the lead screw 210 is supported within the frame 207 by the stepping motor 208 and the bearing 211. The collimating lens 203 moves in the direction indicated by the arrows A together with the rotation of the lead screw 210. The stepping motor 208 is driven in response to a control signal from a CPU 301 described below, and the collimating lens 203 moves in the direction indicated by the arrows A together with the rotation of the lead screw 210. That is, the collimating lens 203 moves along the optical path of the laser beam LM. This changes a focus position of the collimating lens 203, and thus the spot diameter (spot area) of the laser beam LM on the photosensitive drum 112 is changed. The image forming apparatus according to the present embodiment is described using a mechanism for moving the collimating lens 203 as an example. However, an optical lens to be moved is not limited to the collimating lens 203 as long as it can change the spot diameter of the laser beam LM on the photosensitive drum 112 by its movement.

Figure 3:
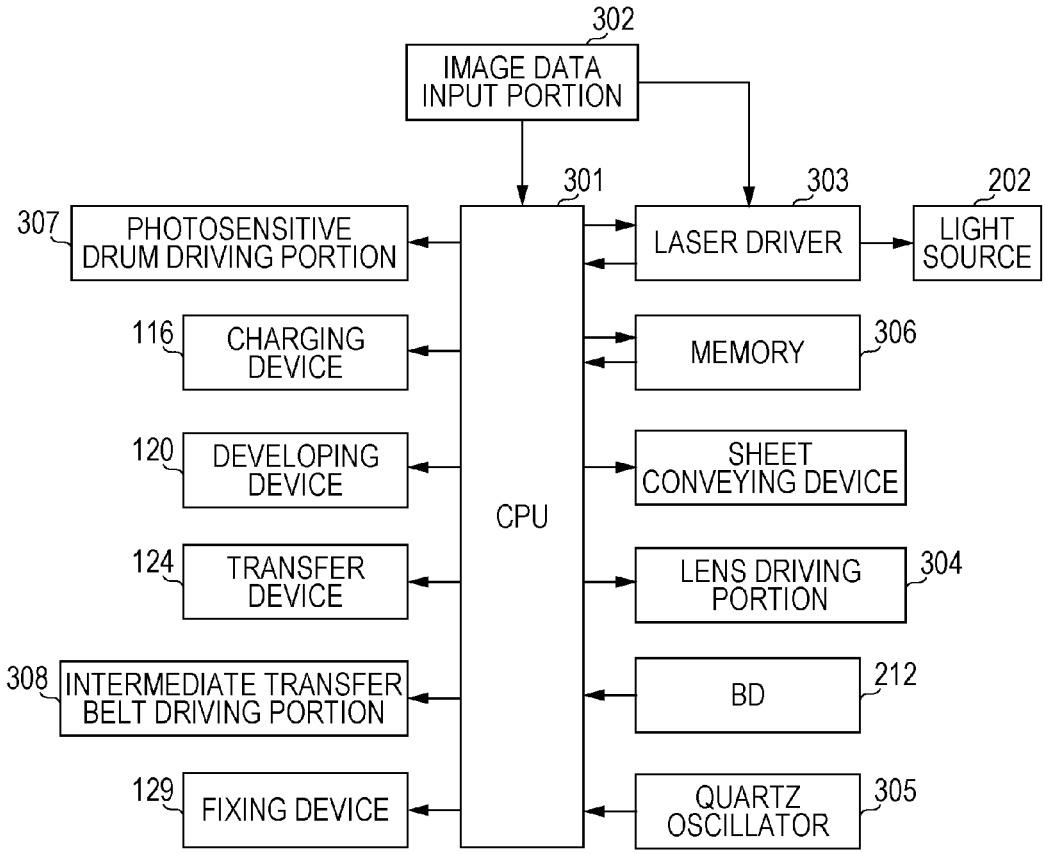
FIG. 3 is a block diagram of an image forming apparatus according to a first embodiment and a third embodiment.

FIG. 3 is a block diagram of the image forming apparatus according to the present embodiment. A control signal for informing an input of image data is transmitted from an image data input portion 302 to the CPU 301. The CPU 301 transmits a control signal in order to form an image in accordance with the image signal to the laser driver 303, the lens driving portion 304, the charging device 116, the developing device 120, the transfer device 124, a photosensitive drum driving portion 307 for driving the photosensitive drum to rotate, an intermediate transfer belt driving portion 308 for driving the intermediate transfer belt to rotate, the fixing device 129, a paper feed device, and the like. In response to that control signal, each device is started. The laser driver 303 controls the timing of emission of the laser beam LM and the laser intensity. For the sake of simplification of description, in the block diagram of FIG. 3, only the developing device 120 and the transfer device 124, which correspond to the image forming portion for forming a magenta image, are illustrated. The developing device corresponds to the developing devices 121, 122, and 123 corresponding to the other colors illustrated in FIG. 1 and the transfer device also corresponds to the transfer devices 125, 126, and 127 in the primary transfer portion and the transfer device 128 in the secondary transfer portion.

The CPU 301 receives a BD signal from the BD 212. The CPU 301 has received a reference clock from a quartz oscillator 305 and, in response to an input of the BD signal, resets a count value and starts counting of the reference clock using its internal counter. When the count value becomes a specific count value, the CPU 301 transmits an enable signal for permitting emission of a laser beam to the laser driver 303. The laser driver 303 has received an image signal subjected to specific image processing performed by an image processing portion (not illustrated) included in the image data input portion. The laser driver 303 drives the light source 202 such that it emits a laser beam on the basis of the above enable signal and the image signal.

The CPU 301 has the function as light intensity control means (light intensity control unit) for controlling the intensity of a laser beam emitted from the light source. The CPU 301 transmits a control signal for use in controlling the intensity of a laser beam to the laser driver 303.

A memory 306 illustrated in FIG. 3 stores a table for conversion from the type of recording paper to the spot diameter and a table for conversion from the spot diameter to the amount of movement of the collimating lens, the tables being described below. The above-described control signal input from the image data input portion 302 to the CPU 301 contains information about the type of recording paper on which an image is to be formed. The information about the type of recording paper may be input by a user in image formation, or alternatively, if a user does not select recording paper, the CPU 301 may automatically select recording paper on which an image is to be formed. The CPU 301 transmits a control signal to the lens driving portion 304 on the basis of the conversion table stored in the memory 306 such that the spot diameter of a laser beam on the photosensitive drum is a desired spot diameter in accordance with the type of recording paper.

Figure 4:
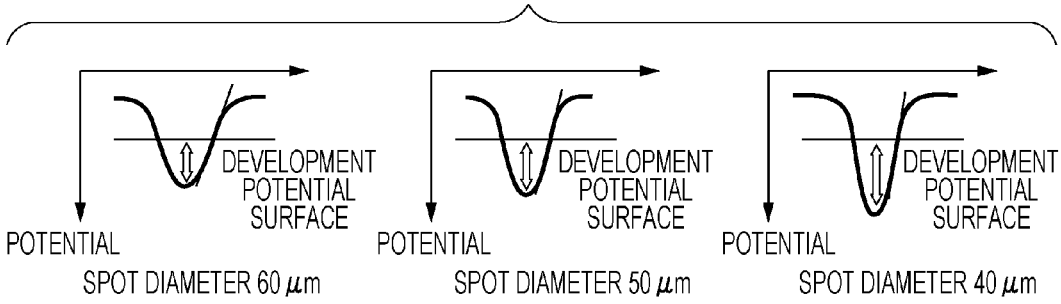
FIG. 4 illustrates latent-image profiles corresponding to 1 dot obtained in simulation when a photosensitive drum is exposed with a laser beam.

A reason for changing the spot diameter of a laser beam on the photosensitive drum is described below. First, correlation between a potential profile of an electrostatic latent image formed on a photosensitive drum by exposure with a laser beam (latent-image profile) and Gaussian distribution representing the intensity of the laser beam (exposure profile) is described. Although not illustrated, the distribution of laser light intensity exhibits Gaussian distribution. FIG. 4 illustrates latent-image profiles corresponding to 1 dot obtained in simulation when a photosensitive drum is exposed with a laser beam. In FIG. 4, the vertical axis indicates a potential of an electrostatic latent image, and the horizontal axis indicates potential distribution. In FIG. 4, a potential at or below a development potential surface is a potential at which development is performed using toner. FIG. 4 illustrates latent-image profiles occurring when the spot diameter is 60 μm, 50 μm, and 40 μm in sequence from the left. As illustrated in FIG. 4, as in the case of the distribution of laser light intensity, each of the latent-image profiles also exhibits Gaussian distribution, and it illustrates that, if the spot diameter of a laser beam is changed by the use of the above lens driving portion 304, the latent-image profile changes in accordance with it. Specifically, if the spot diameter is reduced without changing the intensity of a laser beam, the width of the latent-image profile is narrowed and the depth of the latent-image profile is increased. The reason for this is that a reduction in the spot diameter moves charges in a photosensitive layer in a direction in which a latent image is deepened. This increases the slope of the latent-image profile at the development potential surface, as illustrated in FIG. 4. That is, the peak intensity of the exposure profile is increased, and the peak intensity of the latent-image profile correlated therewith is also increased.

Accordingly, the latent-image profile tends to change similarly to a change of the exposure profile. One reason for this is that because the number of excited carries generated in a charge generating layer of the photosensitive drum depends on the exposure intensity, the exposure profile is reflected in the latent-image profile, for example, the slope of distribution of excited carriers and the peak value. Because the exposure profile and the latent-image profile are highly correlated, the latent-image profile can be controlled by controlling the exposure profile by, for example, changing the spot diameter of a laser beam. As a result, controlling the exposure profile enables controlling the height of toner forming 1 dot and the area of 1 dot (one pixel) on the photosensitive drum.

Ideally, the slope of the latent-image profile at the development potential surface should be always constant, but in reality, the slope of the latent-image profile at the development potential surface is not constant and slightly changes. When the slope slightly changes, the outer shape of 1 dot slightly changes. If the slope of the latent-image profile at the development potential surface is small, the amount of change in the slope is large, and therefore, the amount of change in the above outer shape of 1 dot is increased. In contrast, forming an electrostatic latent image using a laser beam having a reduced spot diameter increases the slope of the latent-image profile at the development potential surface. The increase in the slope of the latent-image profile at the development potential surface reduces the change in the outer shape of a toner image corresponding to 1 dot on the photosensitive drum, and toner is developed faithfully to the latent image.

In this way, reducing the area of 1 dot enables formation of a high-resolution image. The reduction in the area of 1 dot can be achieved by reducing the area exposed with a laser beam (spot area). One way to do this is reducing the spot diameter of a laser beam in guiding the light beam on a photosensitive drum.

In FIG. 4, because the spot diameter is reduced when the intensity of a laser beam is constant, the peak intensity of the exposure profile is high. The high peak intensity increases the amount of potential decay, and thus the depth of the latent-image profile formed by a laser beam with a reduced spot diameter is increased, as illustrated in FIG. 4. However, when the depth of the latent-image profile is increased, the height of its developed toner image is increased.

The increase in the height of a toner image causes variations in the spread of the toner image in a fixing process. The variations increase graininess occurring in the image and make the image grainy. In particular, to form an image on recording paper having high surface smoothness, such as coated paper, or recording paper having high smoothness and low toner penetration, because a fixing process increases the spread of a toner image, the influence of the height of the toner layer on the graininess previously described is increased. FIGS. 5A and 5B are diagrams illustrating how a toner image is flattened by fixing when toner having the same height and the same amount is placed on plain paper and coated paper. FIG. 5A illustrates a state in which toner is placed on each of coated paper and plain paper before fixing, and FIG. 5B illustrates a state in which toner is fixed by heat and pressure applied thereto. For plain paper having low surface smoothness, toner penetrates into gaps of fibers of the paper in fixing, and therefore, the spread of the toner in fixing can be reduced. The same applies to coated paper having a toner reception layer. In contrast, for coated paper having high surface smoothness, toner is greatly spread over the surface of the paper and fixed. Accordingly, the spread of toner in fixing varies. The variations make grains of dots visually noticeable. That is, the graininess of an image is increased, and the image looks grainy.

Accordingly, a reduction in the spot diameter enables formation of a high-resolution image, but unevenness of the spread of toner in fixing increases graininess of the image. In contrast, if an increase in the height of a toner image is reduced by an increase in the spot diameter to reduce the graininess of an image, the area of 1 dot is increased and thus formation of a high-resolution image becomes difficult.

Here, RMS granularity (hereinafter referred to as granularity), which is a qualification of graininess, is described. The granularity is an index for standardization of graininess of an image and is standardized by ANSI PH-2.40-1985. The granularity is provided by a standard deviation of density distribution of an image (test image) and calculated using the following expression.

$$GRANULARITY\sigma_D = \sqrt{\frac{1}{N}\sum_{i=1}^{N}(Di-\overline{D})^2}$$

Di indicates density distribution, and $\overline{D}$ indicates a mean density. When the granularity is large, because graininess is increased, an output image looks grainy.

The image forming apparatus according to the present embodiment can reduce an increase in the granularity and reduce a grainy image by setting the spot diameter of a laser beam on a photosensitive drum in image formation at a spot diameter suited for recording paper on which an image is to be formed.

The image forming apparatus according to the present embodiment stores a table for conversion from the type of recording paper to the spot diameter for use in calculating a target spot diameter of a laser beam from the type of recording paper (hereinafter referred to as first conversion table) in the memory 306 and controls the spot diameter of the laser beam on the photosensitive drum on the basis of that table. The first conversion table is created on the basis of determination of an optimal spot diameter from a relationship between spot diameters of various types of recording paper and granularities obtained, for example, in design or prior to shipment from the factory.

One example method of creating the first conversion table is described below. FIG. 6 illustrates a relationship between a spot diameter and granularity of an image. In design or prior to shipment from the factory, a plurality of spot diameters is first set, the above test image is formed for each spot diameter, and the granularity of each test image is calculated. This process is performed on various types of recording paper, and a relationship between a spot diameter and granularity of an image for each type of recording paper, as illustrated in FIG. 6, is calculated. A curve 601 illustrates a relationship between a spot diameter and granularity of an image for plain paper (referred to as second recording medium). A curve 602 illustrates a relationship between a spot diameter and granularity of an image for coated paper [1] (referred to as first recording medium). A curve 603 illustrates a relationship between a spot diameter and granularity of an image for coated paper [2] (referred to as third recording medium). Referring to the curve 601, in the case of formation of an image on plain paper, it is found that when the spot diameter on a photosensitive drum is set at approximately 40 μm, an image with more reduced granularity is obtainable, in comparison with that using other spot diameters. Referring to the curve 602, in the case of formation of an image on coated paper [1], it is found that when the spot diameter on a photosensitive drum is set at approximately 50 μm, an image with more reduced granularity is obtainable, in comparison with that using other spot diameters. Referring to the curve 603, in the case of formation of an image on coated paper [2], it is found that when the spot diameter on a photosensitive drum is set at approximately 60 μm, an image with more reduced granularity is obtainable, in comparison with that using other spot diameters.

Thus, the memory 306 stores a first table, as provided below as Table 1, as the first conversion table. The CPU 301 sets the spot diameter of a laser beam on a photosensitive drum in image formation on the basis of the type of recording paper and the first conversion table. The CPU 301 refers to the first conversion table before image formation, and transmits a control signal for setting the spot diameter at 40 μm to the lens driving portion 304 if an image is to be formed on plain paper. The CPU 301 transmits, to the lens driving portion 304, a control signal for setting the spot diameter at 50 μm if an image is to be formed on the coated paper [1] and a control signal for setting the spot diameter at 60 μm if an image is to be formed on the coated paper [2].

TABLE 1

| TYPE OF RECORDING PAPER | PLAIN PAPER | COATED PAPER [1] | COATED PAPER [2] |
|---|---|---|---|
| SPOT DIAMETER | 40 μm | 50 μm | 60 μm |

The above conversion table is stored in the memory 306 prior to shipment from the factory. However, because many types of recording paper are available, it is impossible to store spot diameters for all types of recording paper in the memory 306, and additionally, which type of recording paper is used by a user is unclear. Therefore, a new conversion table may be stored in the memory 306 by a user or repair people as the first conversion table depending on usage by the user.

A table for conversion from the spot diameter to the amount of movement of the collimating lens for use in calculating the amount of movement of the collimating lens 203 from a spot diameter selected according to the type of recording paper (see Table 2; hereinafter referred to as second conversion table) is stored in the memory 306. The CPU 301 determines the amount of movement of the collimating lens 203 on the basis of the spot diameter selected by the CPU 301 and the second conversion table. The above first conversion table and second conversion table are control data elements for use in changing the spot diameter.

TABLE 2

| SPOT DIAMETER (μm) | AMOUNT OF MOVEMENT OF COLLIMATING LENS (mm) |
|---|---|
| 40 | 0 |
| 45 | 0.6 |
| 50 | 1.2 |
| 55 | 1.8 |
| 60 | 2.5 |
| 65 | 3.6 |

For the image forming apparatus according to the present embodiment, the spot diameter on the photosensitive drum when the collimating lens 203 is at the home position is 40 μm. This home position is set in consideration of that plain paper is most frequently used. That is, the home position is set such that an image can be formed on plain paper without control of driving the collimating lens 203.

Referring to the first conversion table of Table 1, in the case of image formation on plain paper, a target spot diameter is 40 μm. Referring to the second conversion table of Table 2, when the spot diameter is 40 μm, the amount of movement of the collimating lens 203 is 0 μm. Consequently, in the case of image formation on plain paper, the collimating lens 203 is not moved.

In the case of image formation on coated paper [1], the CPU 301 determines that the spot diameter is 50 μm on the basis of the first conversion table of Table 1. Then, the CPU 301 determines that the amount of movement of the collimating lens 203 is 1.2 mm from the second conversion table of Table 2. The CPU 301 transmits, to the lens driving portion 304, a control signal for moving the collimating lens 203 by 1.2 mm toward the polygonal mirror.

In the case of image formation on coated paper [2], the CPU 301 determines that the spot diameter is 60 μm on the basis of the first conversion table of Table 1. Then, the CPU 301 determines that the amount of movement of the collimating lens 203 is 2.5 mm from the second conversion table of Table 2. The CPU 301 transmits, to the lens driving portion 304, a control signal for moving the collimating lens 203 by 2.5 mm toward the polygonal mirror.

Figure 7:
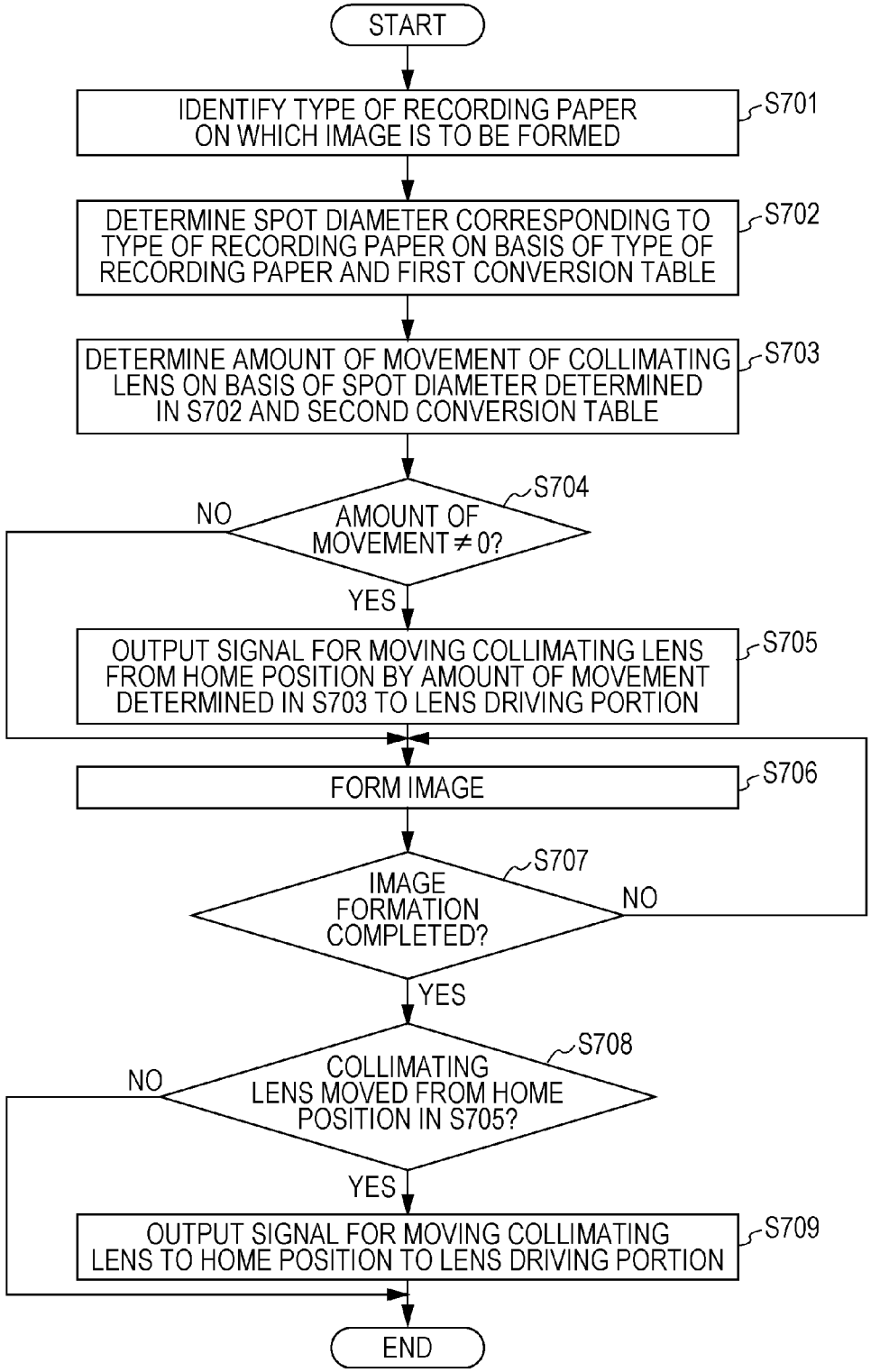
FIG. 7 illustrates a flow of control performed in image formation by a central processing unit (CPU) of the image forming apparatus according to the first embodiment.

FIG. 7 illustrates a flow of control performed by the CPU 301 in image formation. This control is started in response to an input of a signal into the CPU 301, the signal notifying an input of image data from the image data input portion 302 by a user. The CPU 301 identifies the type of recording paper selected by the user from the types of recording paper stored in the memory 306 (step S701). The user selects recording paper on which an image is to be formed when inputting image data. The CPU 301 identifies which recording paper has been selected by the user from the recording paper stored in the memory 306. The spot diameter of a laser beam on the photosensitive drum in image formation is determined on the basis of the type of recording paper identified in step S701 and the first conversion table (step S702). Subsequently, the amount of movement of the collimating lens 203 is determined on the basis of the spot diameter determined in step S702 and the second conversion table (step S703). The CPU 301 determines whether the amount of movement of the collimating lens 203 determined in step S703 is 0 mm (step S704). If it is determined in step S704 that the amount of movement of the collimating lens 203 is not 0 mm, the CPU 301 transmits, to the lens driving portion 304, a control signal by which the collimating lens 203 is moved from the home position by the amount of movement determined in step S703 (step S705). After the movement of the collimating lens 203 is completed, an image is formed (step S706). If it is determined in step S704 that the amount of movement of the collimating lens 203 is 0 mm (for the present embodiment, in the case of image formation on plain paper), flow proceeds to step S706.

After step S706, the CPU 301 determines whether image formation for all image signals input into the laser driver 303 has been completed (step S707). If it is determined in step S707 that image formation for all image signals input into the laser driver 303 has been completed, the CPU 301 determines whether in step S705 the control signal for moving the collimating lens 203 was output (step S708). If the collimating lens 203 was moved in step S705, the CPU 301 transmits a control signal for returning the collimating lens 203 to the home position (step S709) to the lens driving portion 304 and ends the control. If it is determined in step S708 that the collimating lens 203 was not moved in step S705, the CPU 301 ends the control.

As described above, the image forming apparatus according to the present embodiment can control the height of a toner image occurring when an electrostatic latent image is developed by changing an exposure area corresponding to 1 dot in accordance with the type of recording paper on which an image is to be formed. With the image forming apparatus according to the present embodiment, an image can be formed on coated paper without changing the resolution of the image, such as changing the screen line number. This can reduce deterioration in reproducibility of an original image and reduce granularity of an image.

Second Embodiment

For the present embodiment, an image forming apparatus that controls laser light intensity together with movement of the collimating lens 203 is described. In the case of image formation on coated paper, the collimating lens 203 is moved such that the spot diameter is reduced. Then, the width of intensity distribution of the latent-image profile is expanded. When the electrostatic latent image of this latent-image profile is developed and fixed, the area on the recording paper covered by toner is increased. When the covered area is increased, the density of the image is increased, in comparison with that occurring when the collimating lens 203 is not moved. To reduce such a variation in the density, in the case where the collimating lens 203 is moved, the CPU 301 refers to a table for conversion from the amount of movement of the collimating lens to the laser light intensity (third conversion table), as provided below as Table 3, and determines the laser light intensity of a laser beam to be emitted from the light source 202. Then, the CPU 301 transmits a control signal for achieving the determined laser light intensity to the laser driver 303.

In the case where the collimating lens 203 is not moved (for example, in image formation on plain paper), the laser light intensity is set at 100%. In Table 3, the spot diameter increases with an increase in the amount of movement of the collimating lens 203. The third conversion table is set such that the laser light intensity reduces with an increase in the spot diameter.

TABLE 3

| AMOUNT OF MOVEMENT OF COLLIMATING LENS (mm) | LASER LIGHT INTENSITY (%) |
|---|---|
| 0 | 100 |
| 0.6 | 96 |
| 1.2 | 92 |
| 1.8 | 88 |
| 2.5 | 84 |
| 3.6 | 80 |

Figure 8:
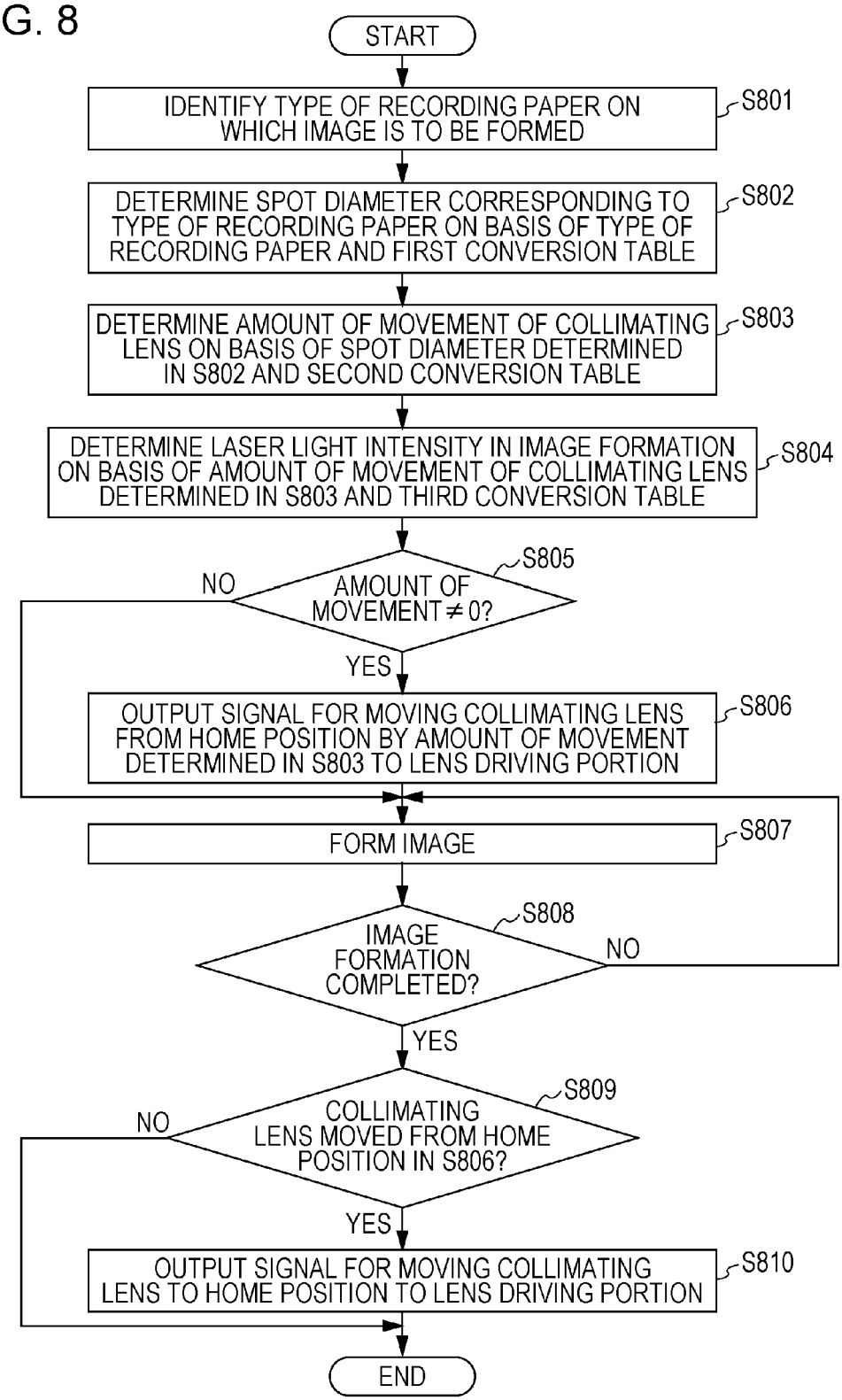
FIG. 8 illustrates a flow of control performed in image formation by a CPU of an image forming apparatus according to a second embodiment.

A flow of control performed by the CPU 301 according to the present embodiment is described using FIG. 8. A block diagram in the present embodiment is substantially the same as in the first embodiment, so it is not described here.

The CPU 301 identifies the type of recording paper selected by a user from the types of recording paper stored in the memory 306 (step S801). The user selects recording paper on which an image is to be formed when inputting image data. The CPU 301 identifies which recording paper has been selected by the user from the recording paper stored in the memory 306. The spot diameter of a laser beam on the photosensitive drum in image formation is determined on the basis of the type of recording paper identified in step S801 and the first conversion table (step S802). Subsequently, the amount of movement of the collimating lens 203 is determined on the basis of the spot diameter determined in step S802 and the second conversion table (step S803). Subsequently, the CPU 301 determines the laser light intensity for use in image formation in an image formation step described below on the basis of the amount of movement of the collimating lens 203 determined in step S803 and the third conversion table (step S804).

The CPU 301 determines whether the amount of movement of the collimating lens 203 determined in step S803 is 0 mm (step S805). If it is determined in step S805 that the amount of movement of the collimating lens 203 is not 0 mm, the CPU 301 transmits, to the lens driving portion 304, a control signal by which the collimating lens 203 is moved by the amount of movement from the home position (step S806). After the movement of the collimating lens 203 is completed, an image is formed (step S807). If it is determined in step S805 that the amount of movement of the collimating lens 203 is 0 mm (for the present embodiment, in the case of image formation on plain paper), flow proceeds to step S807.

After step S807, the CPU 301 determines whether image formation for all image signals input into the laser driver 303 has been completed (step S808). If it is determined in step S808 that image formation for all image signals input into the laser driver 303 has been completed, the CPU 301 determines whether in step S806 the control signal for moving the collimating lens 203 was output. If the collimating lens 203 was moved in step S806, the CPU 301 transmits a control signal for returning the collimating lens 203 to the home position to the lens driving portion 304 (step S810) and ends the control. If it is determined in step 809 that the collimating lens 203 was not moved in step S806, the CPU 301 ends the control.

Accordingly, deterioration in density reproducibility to an original image can be reduced by controlling the intensity of a laser beam in accordance with the amount of movement of the collimating lens 203.

Third Embodiment

For the first embodiment, an example in which the type of recording paper is identified on the basis of information indicating selection of recording paper by a user in image formation is described. For the present embodiment, a configuration in which the surface smoothness of recording paper is automatically detected by a gloss measuring device and the spot diameter of a laser beam (exposure area corresponding to 1 dot) on a photosensitive drum in image formation is changed on the basis of the detected smoothness is described. The higher the gloss of recording paper, the higher the surface smoothness of recording paper, and therefore, the larger the influence of the height of a toner image on the granularity of an image. Thus, for the present embodiment, the height of a toner image is changed by changing the spot diameter in accordance with the gloss. The present embodiment differs from the first embodiment in that a gloss measuring device 901 (see FIG. 1) is disposed on a conveying path in the vicinity of the paper feed cassettes. Other configurations are common to the first embodiment. The common parts are not described here.

Figure 9:
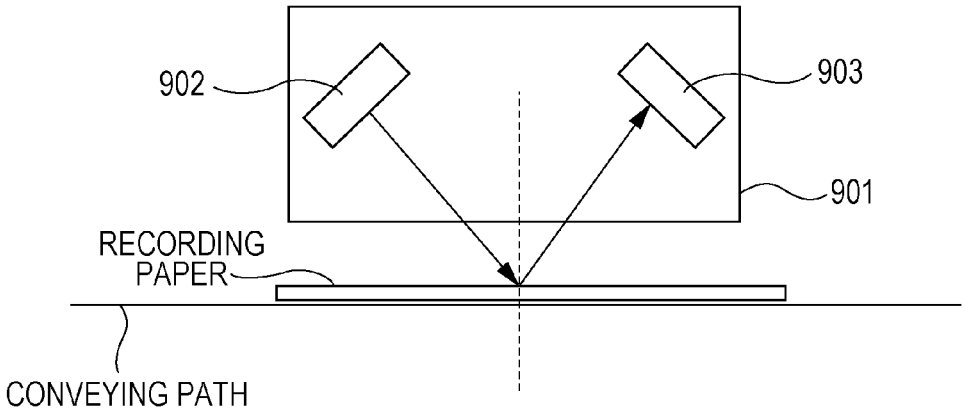
FIG. 9 is a schematic cross-sectional view of a gloss measuring device.

FIG. 9 is a schematic cross-sectional view of the gloss measuring device 901. The gloss measuring device 901 includes a light emitting element 902 for emitting light toward the conveying path and a light receiving element 903 for receiving specularly reflected light of the light emitted from the light emitting element 902. The gloss measuring device 901 is configured to carry out measurement using a method defined by JISZ8741. The light receiving element 903 is arranged at a location where reflected light at a prescribed opening angle θ with respect to light incident on recording paper is detected. The gloss of recording paper is determined from the ratio between the intensity of light emitted from the light emitting element 902 and the intensity of reflected light received by the light receiving element 903 (emitted light intensity/received light intensity). The larger this ratio, the higher the intensity of specularly reflected light, and therefore, the higher the surface smoothness of recording paper.

Figure 10:
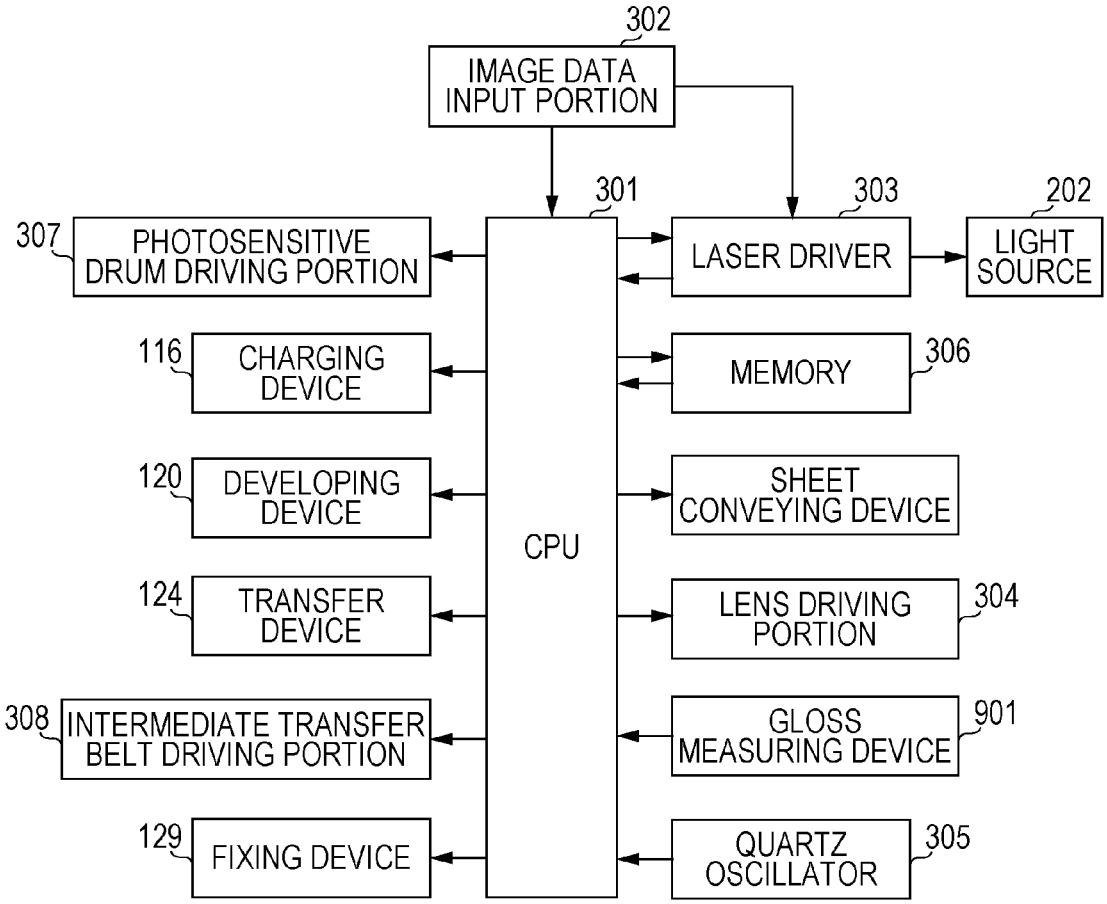
FIG. 10 is a block diagram of the image forming apparatus according to the third embodiment.

FIG. 10 is a block diagram of the image forming apparatus according to the present embodiment. This block diagram differs from the block diagram for the image forming apparatus according to the first embodiment (FIG. 3) in that the gloss measuring device 901 is newly disposed. The CPU 301 detects the gloss of recording paper on the basis of an output from the gloss measuring device 901. The memory 306 stores a table for conversion between the gloss and the spot diameter (hereinafter referred to as fourth conversion table), as provided below as Table 4. In addition, the memory 306 stores a table that is more finely specified than the table described as Table 2 in the first embodiment. The CPU 301 determines the amount of movement of the collimating lens 203 on the basis of the second conversion table and the spot diameter obtained from the fourth conversion table.

TABLE 4

| GLOSS (%) | SPOT DIAMETER (μm) |
|---|---|
| . | . |
| . | . |
| . | . |
| 50~55 | 55 |
| 55~60 | 57 |
| 60~65 | 60 |
| . | . |
| . | . |
| . | . |

Figure 11:
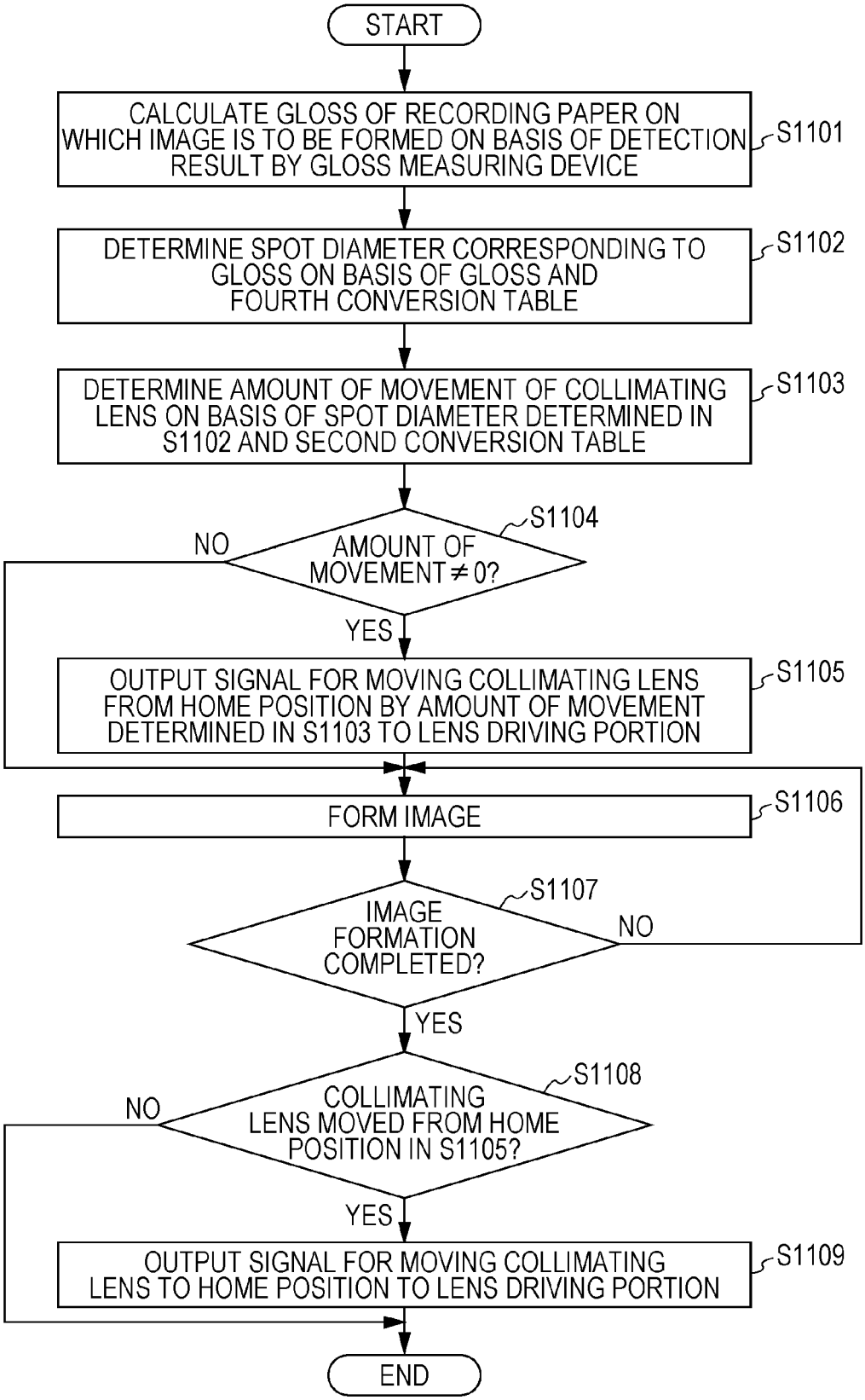
FIG. 11 illustrates a flow of control performed in image formation by a CPU of the image forming apparatus according to the third embodiment.

Next, a flow of control performed by the CPU 301 in image formation according to the present embodiment is described using FIG. 11. This control is started in response to an input of a signal into the CPU 301, the signal notifying an input of image data from the image data input portion 302 by a user. The CPU 301 detects the gloss of recording paper on which an image is to be formed on the basis of detection by the gloss measuring device 901 (step S1101). The spot diameter of a laser beam on the photosensitive drum in image formation is determined on the basis of the gloss detected in step S1101 and the fourth conversion table (step S1102). Subsequently, the amount of movement of the collimating lens 203 is determined on the basis of the spot diameter determined in step S1102 and the second conversion table (step S1103). The CPU 301 determines whether the amount of movement of the collimating lens 203 determined in step S1103 is 0 mm (step S1104). If it is determined in step S1104 that the amount of movement of the collimating lens 203 is not 0 mm, the CPU 301 transmits, to the lens driving portion 304, a control signal by which the collimating lens 203 is moved from the home position by the amount of movement determined in step S1103 (step S1105). After the movement of the collimating lens 203 is completed, an image is formed (step S1106). If it is determined in step S1104 that the amount of movement of the collimating lens 203 is 0 mm (for the present embodiment, in the case of image formation on plain paper), flow proceeds to step S1106.

After step S1106, the CPU 301 determines whether image formation for all image signals input into the laser driver 303 has been completed (step S1107). If it is determined in step S1107 that image formation for all image signals input into the laser driver 303 has been completed, the CPU 301 determines whether the collimating lens 203 is moved in step S1105 or not (step S1108). If the collimating lens 203 was moved in step S1105, the CPU 301 transmits a control signal for returning the collimating lens 203 to the home position (step S1109) to the lens driving portion 304 and ends the control. If it is determined in step S1108 that the collimating lens 203 was not moved in step S1105, the CPU 301 ends the control.

As described above, the image forming apparatus according to the present embodiment changes the spot diameter of a laser beam on the photosensitive drum on the basis of measurement carried out by the gloss measuring device. Even for the same type of recording paper, the surface smoothness varies. With the image forming apparatus according to the present embodiment, the granularity of an image can be reduced in accordance with the variations in smoothness.

Fourth Embodiment

For the first embodiment, the image forming apparatus capable of changing the spot diameter of a laser beam on the photosensitive drum by moving the collimating lens 203 is described. The image forming apparatus according to the present embodiment has no configuration for moving the collimating lens 203. The image forming apparatus according to the present embodiment can change an exposure area corresponding to 1 dot by exposing the same section of the surface of the photosensitive drum a plurality of times (making multiple exposures).

Figure 12A:
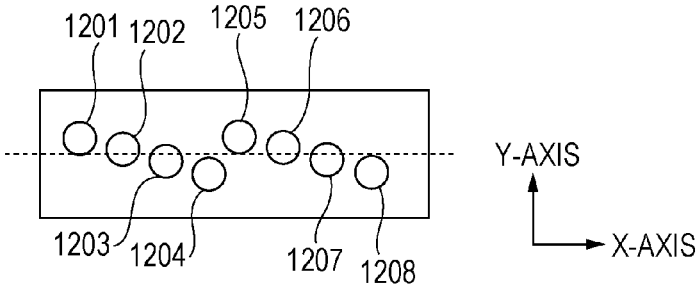
FIGS. 12A and 12B illustrate schematic diagrams of a light source used in an image forming apparatus according to a fourth embodiment.

As illustrated in FIG. 12A, the light source 202 is a laser light source having 16 laser luminous points. The sixteen luminous points (luminous points 1201 to 1208) are arranged in two rows. The luminous points 1201 to 1204 are arranged in a first row, and the luminous points 1205 to 1208 are arranged in a second row. The dot lines illustrated in FIG. 12A is an imaginary axis corresponding to the rotation shaft of the photosensitive drum (in a main-scanning direction). The X-axis illustrated in FIG. 12A corresponds to the main-scanning direction on the photosensitive drum, and the Y-axis corresponds to a sub-scanning direction. The row of the luminous points 1201 to 1204 and the row of the luminous points 1205 to 1208 are inclined to the above imaginary axis. With such arrangement of the luminous points, in comparison with a configuration in which the luminous points are arranged in the Y-axis, the interval between scan paths (scan lines) of laser beams on the photosensitive drum in the sub-scanning direction can be reduced, and an image can be formed with high resolution.

Figure 12B:
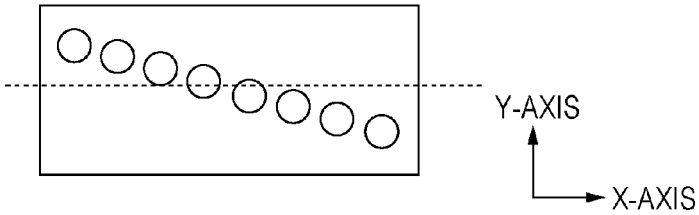

The resolution of an exposure spot formed on the photosensitive drum is 1200 dpi in a direction in which a laser beam scans (main-scanning direction) and the sub-scanning direction, which is perpendicular to the main-scanning direction. Therefore, the pitch of elements in the sub-scanning direction and the optical system are designed such that the interval in the sub-scanning direction is approximately 21.3 μm. The intensity distribution of a laser beam emitted from each of the luminous points is Gaussian distribution, and each laser beam exhibits substantially the same Gaussian distribution. The arrangement of the luminous points of the light source 202 is not limited to the one illustrated in FIG. 12A; it may also be 1-row arrangement illustrated in FIG. 12B or it may be irregular as long as it allows multiple exposures. An example in which the luminous points are arranged as illustrated in FIG. 12A is described below.

The above multiple exposures are described. The image forming apparatus according to the present embodiment forms 1 dot by superposing laser beams emitted from at least two luminous points. Four spots formed by laser beams emitted from the luminous points 1205 to 1208 (a group of spots formed in a second exposure) are superposed on four spots formed by laser beams emitted from the luminous points 1201 to 1204 (a group of spots formed in a first exposure). The spot formed by the luminous point 1205 is superposed on the spot formed by the luminous point 1201, and the spot formed by the luminous point 1206 is superposed on the spot formed by the luminous point 1202. Similarly, the spot formed by the luminous point 1207 is superposed on the spot formed by the luminous point 1203, and the spot formed by the luminous point 1208 is superposed on the spot formed by the luminous point 1204.

Figure 13:
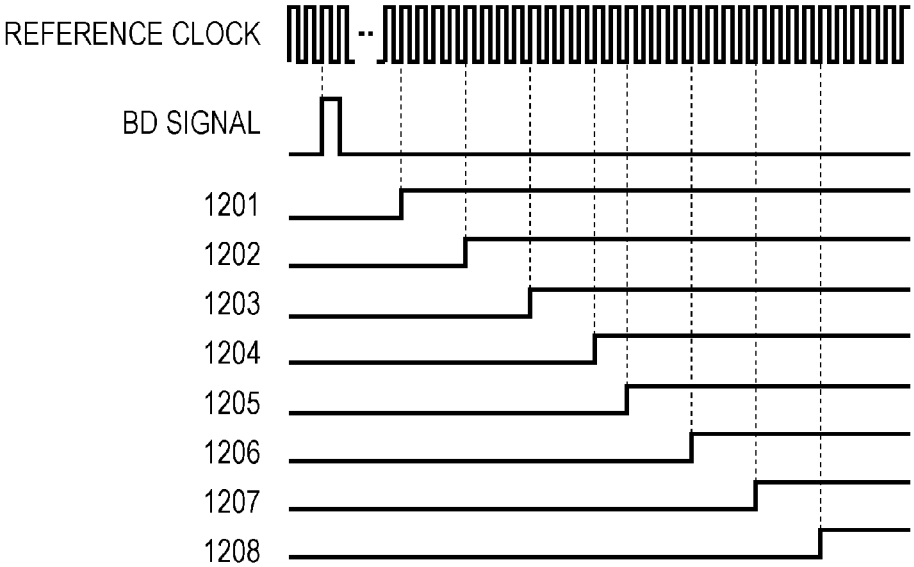
FIG. 13 is an illustration for describing timings of laser emission.

FIG. 13 is a timing chart that illustrates timings of laser emission when the second spots formed by laser beams emitted from the luminous points 1205 to 1208 are fully superposed on the first spots formed by laser beams emitted from the luminous points 1201 to 1204. A reference clock and a BD signal illustrated in FIG. 13 are input into the CPU 301. The reference clock is a high-frequency clock signal. For the sake of simplification of description, a short-period clock signal is illustrated in FIG. 13. In response to an input of a BD signal, the CPU 301 resets an incorporated counter and starts counting of the reference clock from the reset value. When the count value of the counter reaches a count value corresponding to the luminous point 1201, the CPU 301 outputs, to the laser driver, an enable signal for permitting emission of a laser beam from the luminous point 1201. Similarly, for the other luminous points, the CPU outputs an enable signal for each luminous point to the laser driver when the counter count value reaches a count value for the luminous point. A luminous point for which an enable signal and an image signal have been input emits a laser beam.

As illustrated in FIG. 12A, because the luminous points 1201 to 1204 and 1205 to 1208 are inclined to the scan axis, it is necessary for emission timings to vary by luminous point. Thus, as described above, the CPU 301 outputs an enable signal to the laser driver on the basis of a count value corresponding to each luminous point. The count values corresponding to the luminous points are stored in the memory.

Figure 14A:
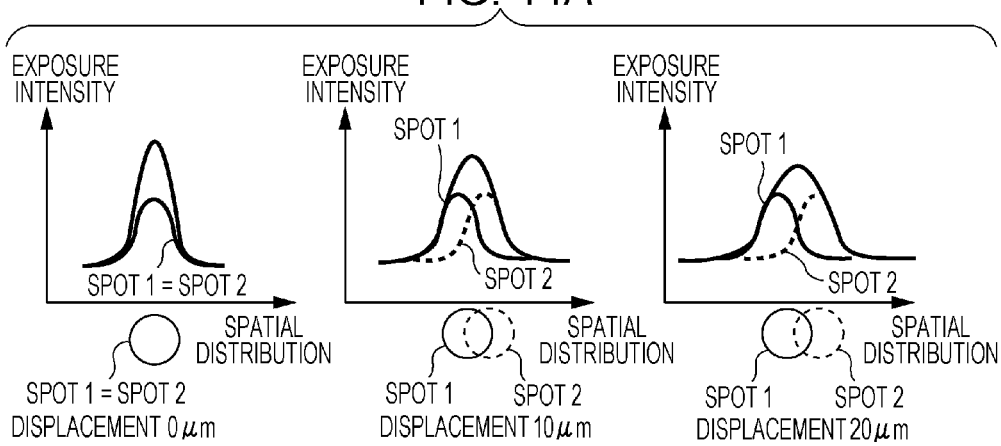
FIGS. 14A to 14C illustrate exposure profiles and latent-image profiles.
Figure 14B:
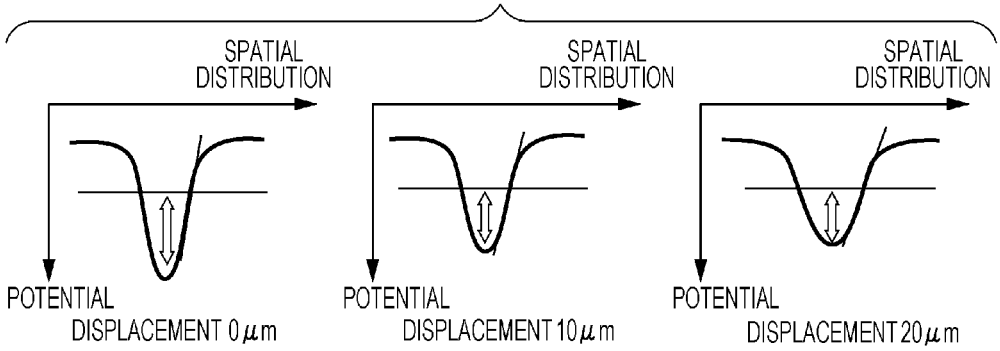
Figure 14C:
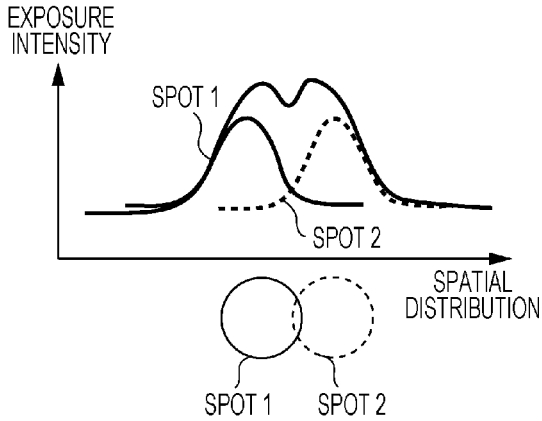

The multiple exposures are described in further detail using FIGS. 14A to 14C. FIG. 14A illustrates exposure profiles when the exposure profiles of two laser beams for multiple exposures are virtually matched. FIG. 14B illustrates latent-image profiles formed when multiple exposures are made using the two laser beams illustrated in FIG. 14A in simulation. The illustration on the left of FIG. 14A illustrates an exposure profile when the displacement Δ between the center of the first spot and the center of the second spot is 0 μm. The illustration on the left of FIG. 14B illustrates a latent-image profile formed on the photosensitive drum when the above displacement Δ is 0 μm. The illustration on the center of FIG. 14A illustrates an exposure profile when the displacement Δ between the center of the first spot and the center of the second spot is 10 μm. The illustration on the center of FIG. 14B illustrates a latent-image profile formed on the photosensitive drum when the above displacement Δ is 10 μm. The illustration on the right of FIG. 14A illustrates an exposure profile when the displacement Δ between the center of the first spot and the center of the second spot is 20 μm. The illustration on the right of FIG. 14B illustrates a latent-image profile formed on the photosensitive drum when the above displacement Δ is 20 μm.

As is clear from FIG. 14A, when the displacement Δ is increased, the intensity peak of the exposure profile is reduced and the width of the intensity distribution is expanded. With this, as illustrated in FIG. 14B, the depth of the latent-image profile is reduced and the intensity distribution is widened. The image forming apparatus according to the present embodiment controls an exposure area corresponding to 1 dot by changing the displacement Δ between the first spot and the second spot in accordance with the type of recording paper. If the displacement Δ is increased too much, the latent-image profile may have two peaks, as illustrated in FIG. 14C, and unnecessary inconsistencies in density may occur in an image. A simulation provides the result that, when the displacement Δ on the photosensitive drum used in the present embodiment is set at 25 μm or less, two peaks do not occur in the latent-image profile. Therefore, the image forming apparatus according to the present embodiment makes multiple exposures such that the displacement Δ is at or below 25 μm.

The image forming apparatus according to the present embodiment forms 1 dot using spots formed by two laser beams. Therefore, the light intensity is lower than that in formation of 1 dot according to the first embodiment. The intensity of a laser beam is set such that the intensity peak of the exposure profile using two laser beams is equal to the intensity peak of the exposure profile of a laser beam according to the first embodiment.

A method of determining displacement Δ in accordance with the type of recording paper on which an image to be formed is described below. The memory 306 stores a table for conversion from the type of recording paper to the displacement of a spot (fifth conversion table), as provided as Table 5 below, the table in which the displacement Δ of the center of a second spot with respect to the center of a first spot for each type of recording paper is set. The CPU 301 determines the displacement of the second spot with respect to the first spot on the basis of the type of recording paper on which an image is to be formed and the fifth conversion table.

TABLE 5

| TYPE OF RECORDING PAPER | PLAIN PAPER | COATED PAPER [1] | COATED PAPER [2] |
|---|---|---|---|
| DISPLACEMENT Δ | 0 μm | 10 μm | 15 μm |

The memory 306 stores a table for conversion from the displacement to the correction count value (sixth conversion table), as provided as Table 6 below. The count value depends on the frequency of a reference clock being a target for counting. Therefore, in the table below, 26 count values A to Z (count value is a natural number containing 0, and A(0)<B . . . Y<Z) are assigned to displacements of 0 to 25 μm. The CPU 301 sets the correction count value on the basis of the displacement Δ and the sixth conversion table. The CPU 301 adds the correction count value to each of the count values set to the luminous points 1205 to 1208. In image formation, the CPU 301 counts a reference clock from an input of a BD signal, and when the count value reaches the count value to which the correction count value is added, the CPU 301 outputs an enable signal for permitting emission from the luminous points 1205 to 1208 to the laser driver 303.

For example, in the case of image formation on plain paper, because the displacement Δ is 0 μm, the CPU 301 determines that the correction count value is A(0). Because the correction count value is 0, the CPU 301 does not correct the count value corresponding to each of the luminous points 1205 to 1208.

In contrast, when the displacement Δ is 10 μm, the CPU 301 determines that the correction count value is K. The CPU 301 adds the correction count value K to the count value set for each of the luminous points 1205 to 1208, and in image formation, the CPU 301 outputs an enable signal to the laser driver when the count value of the reference clock reaches the added count value. Similarly, when the displacement Δ is 15 μm, the CPU 301 determines that the correction count value is P. The CPU 301 adds the correction count value P to the count value set for each of the luminous points 1205 to 1208, and in image formation, the CPU 301 outputs an enable signal to the laser driver when the count value of the reference clock reaches the added count value.

TABLE 6

| DISPLACEMENT Δ (μm) | CORRECTION COUNT VALUE |
|---|---|
| 0 | A (0) |
| . | . |
| . | . |
| . | . |
| 10 | K |
| . | . |

TABLE 6-continued

| DISPLACEMENT Δ (μm) | CORRECTION COUNT VALUE |
|---|---|
| . | . |
| . | . |
| 15 | P |
| . | . |
| . | . |
| . | . |
| 25 | Z |

Figure 15:
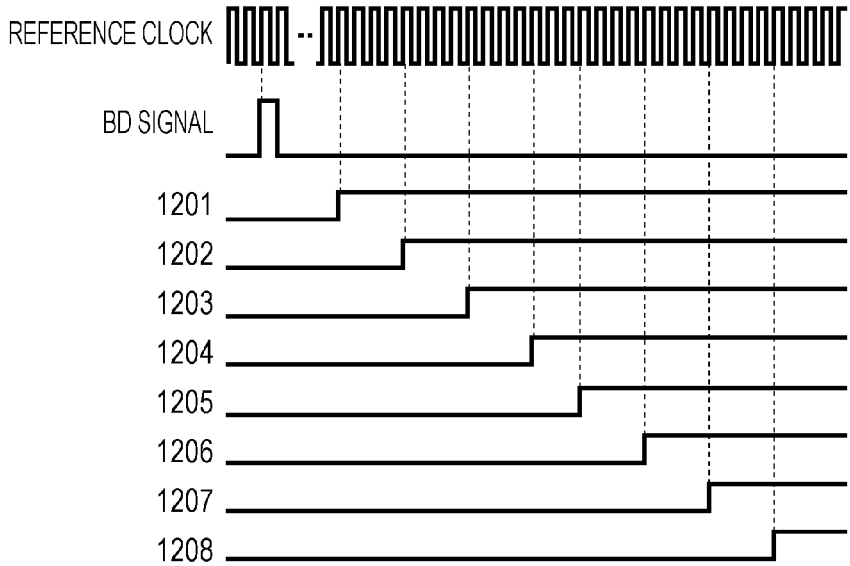
FIG. 15 is an illustration for describing timings of laser emission.

FIG. 15 is a timing chart that illustrates timings of laser emission from each luminous point when the count value is corrected. The count value corresponding to each of the luminous points 1201 to 1204 is not corrected. To displace the center of a second spot formed by a laser beam emitted from each of the luminous points 1205 to 1208 with respect to the center of a first spot formed by a laser beam emitted from each of the luminous points 1201 to 1204, timings of laser emission for the luminous points 1205 to 1208 are delayed by the count value provided in Table 6. For the present embodiment, an example in which the timings of laser emission for the luminous points 1205 to 1208 are delayed by one period of the reference clock is described. However, they may be advanced by one period.

The reference clock has a sufficiently high frequency, and the frequency of the reference clock illustrated in FIG. 15 is merely an example for simply describing delaying the timing of laser emission. As a result, FIG. 15 does not strictly match with the interval between the luminous points illustrated in FIGS. 12A and 12B and the count values of Table 6 (the same applies to FIG. 13).

Figure 16:
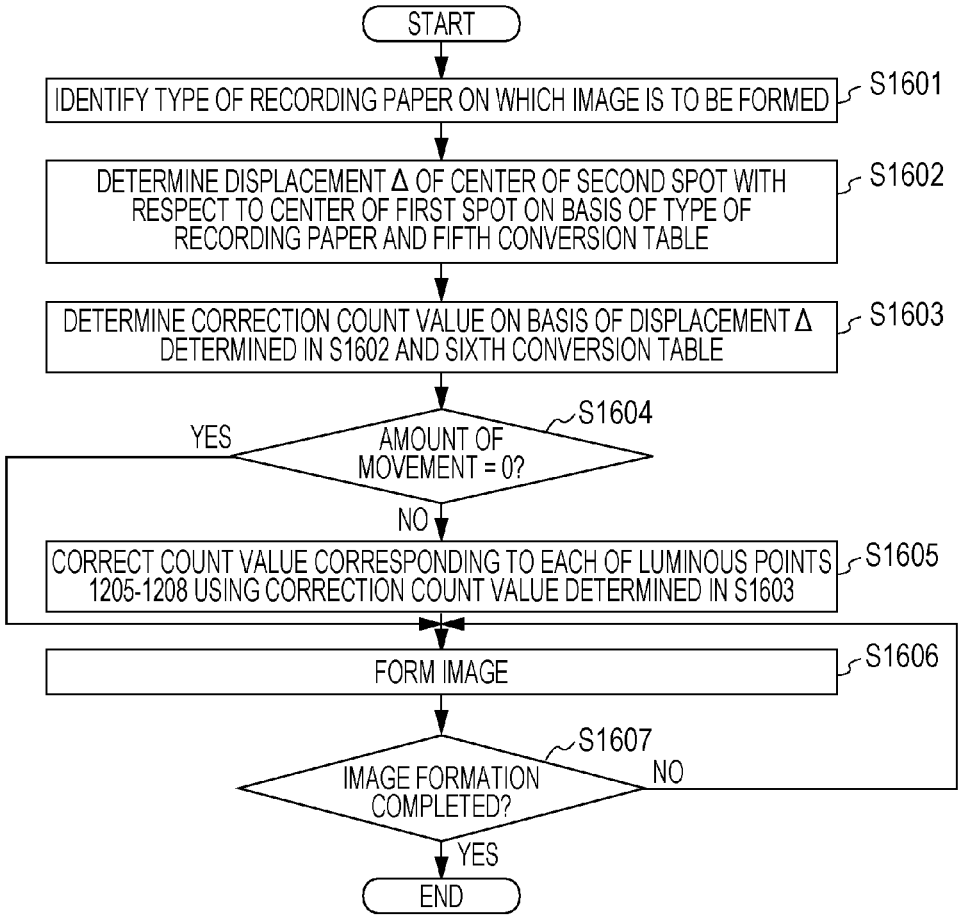
FIG. 16 illustrates a flow of control performed in image formation by a CPU of the image forming apparatus according to the fourth embodiment.

FIG. 16 illustrates a flow of control performed in image formation by the CPU 301. This control is started in response to an input of image data by a user. The CPU 301 identifies the type of recording paper selected by the user from the types of recording paper stored in the memory 306 (step S1601). The displacement Δ of the center of a second spot with respect to the center of a first spot on the photosensitive drum in image formation is determined on the basis of the type of recording paper identified in step S1601 and the fifth conversion table (step S1602). Subsequently, the correction count value is determined on the basis of the displacement Δ determined in step S1602 and the sixth conversion table (step S1603). The CPU 301 determines whether the correction count value determined in step S1603 is zero (step S1604). If it is determined in step S1604 that the correction count value is not zero, the CPU 301 corrects the count value corresponding to each of the luminous points 1205 to 1208 by adding the correction count value to that count value (step S1605). After that, an image is formed (step S1606). If it is determined in step S1604 that the correction count value is zero, flow proceeds to step S1606 without correction of the count value corresponding to each of the luminous points 1205 to 1208.

Subsequently, it is determined whether image formation for all input image data has been completed (step S1607). If it is determined in step S1607 that image formation for all input image data has been completed, the CPU 301 ends the control. If it is determined in step S1607 that image formation for all input image data has not been completed, the CPU 301 returns the control to step S1606 and continues the image formation.

Accordingly, the latent-image profile can also be changed by changing the displacement between the centers of spots of two beams. Even with a single beam, in the case of exposure using a pulse-duration modulation system, changing both a pulse width and a laser light intensity can change an exposure width without changing the light intensity for one pixel, and thus similar advantages to those in changing the spot diameter are obtainable.

Deterioration in the reproducibility of an original image resulting from the type of recording paper on which an image is to be formed can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2010/051820, filed Feb. 8, 2010, which is hereby incorporated by reference herein in its entirety.

The invention claimed is:

1. An image forming apparatus for forming an image on a recording medium, the image forming apparatus comprising:

a photo conductor;

a light source configured to emit a light beam for exposing the photo conductor;

an optical lens configured to guide the light beam on the photo conductor, the optical lens being disposed between the photo conductor and the light source;

a development unit configured to develop an electrostatic latent image using toner, the electrostatic latent image being formed on the photo conductor by exposure with the light beam;

a transfer unit configured to transfer a toner image on the photo conductor to the recording medium;

a fixing unit configured to fix the toner image transferred to the recording medium by the transfer unit on the recording medium; and a control unit configured to move the optical lens along an optical path of the light beam so as to make a spot area of the light beam on the photo conductor in image formation on a first recording medium larger than the spot area in image formation on a second recording medium, the second recording medium having lower surface smoothness or higher penetration of the toner into the recording medium in a state in which the toner image is fixed by the fixing unit in comparison with that of the first recording medium, wherein the control unit includes a light intensity control unit configured to control intensity of the light beam such that, when the optical lens is moved so as to make the spot area larger, intensity of the light beam in image formation on the first recording medium is lower than intensity of the light beam in image formation on the second recording medium.

2. The image forming apparatus according to claim 1, further comprising:

a light emitting unit configured to emit light to recording paper before the toner image is transferred thereto; and a light receiving unit configured to receive light reflected from the recording paper, wherein the control unit identifies a type of the recording paper on the basis of intensity of the reflected light received by the light receiving unit with respect to intensity of the light emitted by the light emitting unit.

3. An image forming apparatus for forming an image on a recording medium, the image forming apparatus comprising:

a photo conductor;

a light source configured to emit a light beam for exposing the photo conductor;

an optical lens configured to guide the light beam on the photo conductor, the optical lens being disposed between the photo conductor and the light source;

a development unit configured to develop an electrostatic latent image using toner, the electrostatic latent image being formed on the photo conductor by exposure with the light beam;

a transfer unit configured to transfer a toner image on the photo conductor to the recording medium;

a fixing unit configured to fix the toner image transferred to the recording medium by the transfer unit on the recording medium;

a control unit configured to move the optical lens along an optical path of the light beam so as to make a spot area of the light beam on the photo conductor in image formation on a first recording medium larger than the spot area in image formation on a second recording medium, the second recording medium having lower surface smoothness or higher penetration of the toner into the recording medium in a state in which the toner image is fixed by the fixing unit in comparison with that of the first recording medium; and a storage unit in which control data elements for use in determining a distance to move the optical lens are stored, the control data elements corresponding to the first recording medium and the second recording medium, respectively, wherein the control unit selects a control data element corresponding to a recording medium on which an image is to be formed from among the control data elements stored in the storage unit and determines the distance to move the optical lens on the basis of the selected control data element.

4. The image forming apparatus according to claim 3, wherein the control data elements are set based on a relationship between granularity of an image and the spot area.

5. The image forming apparatus according to claim 3, further comprising:

a light emitting unit configured to emit light to recording paper before the toner image is transferred thereto; and a light receiving unit configured to receive light reflected from the recording paper, wherein the control unit identifies a type of the recording paper on the basis of intensity of the reflected light received by the light receiving unit with respect to intensity of the light emitted by the light emitting unit.

* * * * *